United States Patent [19]

Cluthé

[11] 4,160,520

[45] Jul. 10, 1979

[54] RURAL MAIL BOX

[75] Inventor: George J. Cluthé, Breslau, Canada

[73] Assignee: The Geo. Cluthe Manufacturing Co. Limited, Waterloo, Canada

[21] Appl. No.: 885,969

[22] Filed: Mar. 13, 1978

[51] Int. Cl.[2] ..... B65D 91/00

[52] U.S. Cl. ..... 232/17; 232/45

[58] Field of Search ..... 232/17, 24, 25, 35, 232/38, 45; 312/330

[56] References Cited

U.S. PATENT DOCUMENTS

| | | | |
|---|---|---|---|
| 838,194 | 12/1906 | Larsh | 232/17 |
| 908,543 | 1/1909 | Brown | 232/17 |
| 1,139,491 | 5/1915 | Coon | 232/33 |
| 1,204,580 | 11/1916 | McDonald, Jr. | 232/35 |
| 1,299,740 | 4/1919 | Larson | 232/35 |
| 1,992,640 | 2/1935 | Steen | 232/17 |
| 2,781,964 | 2/1957 | Ledgerwood | 232/17 |
| 2,868,444 | 1/1959 | Whittier | 232/33 X |

*Primary Examiner*—Roy D. Frazier
*Assistant Examiner*—Peter A. Aschenbrenner
*Attorney, Agent, or Firm*—Sim & McBurney

[57] ABSTRACT

A rural mail box is provided having an elongate enclosure and a mail-receiving tray slidable within the enclosure and including an integral front door for the mail box. The tray is hinged part way along its length to permit the front portion thereof to hinge downwardly when the tray is slid part way out to facilitate the positioning of mail in the tray. The mail box is particularly adapted to be formed of plastic material by injection molding.

10 Claims, 4 Drawing Figures

RURAL MAIL BOX

FIELD OF INVENTION

The present invention relates to a rural mail box.

BACKGROUND OF THE INVENTION

Rural mail boxes of many types have been known for a considerable period of time. Generally, these mail boxes comprise an elongate enclosure which has a door at one end to permit access to the interior, with the doors generally being sprung to assist in their closure.

Some prior art mail boxes have been provided with trays which slide in and out of the enclosure. Where such slidable trays are provided, the sliding mechanism is usually actuated by door opening and closing, often by complex lever and other mechanisms. Typical prior art patents are U.S. Pat. Nos. 907,787, 908,543, 1,050,252, 1,471,899, 1,483,077 and 3,606,140.

A major problem associated with spring mechanisms for door closures is that the spring tends to wear out, so that positive door closure no longer is effected by the spring and this is a particular problem with doors which are hinged at the bottom.

SUMMARY OF INVENTION

The present invention provides a rural mail box having an improved structure wherein the door is formed integral with a slidable tray, so that no spring is required and spring wear problems are avoided. The tray also is hinged part way along its length so that the front portion of the tray including the integral door may be hinged downwardly to allow ready access to the interior of the mail box and to provide a convenient receptacle for mail or other items delivered from a motor vehicle.

DESCRIPTION OF PREFERRED EMBODIMENT

Figure 1:
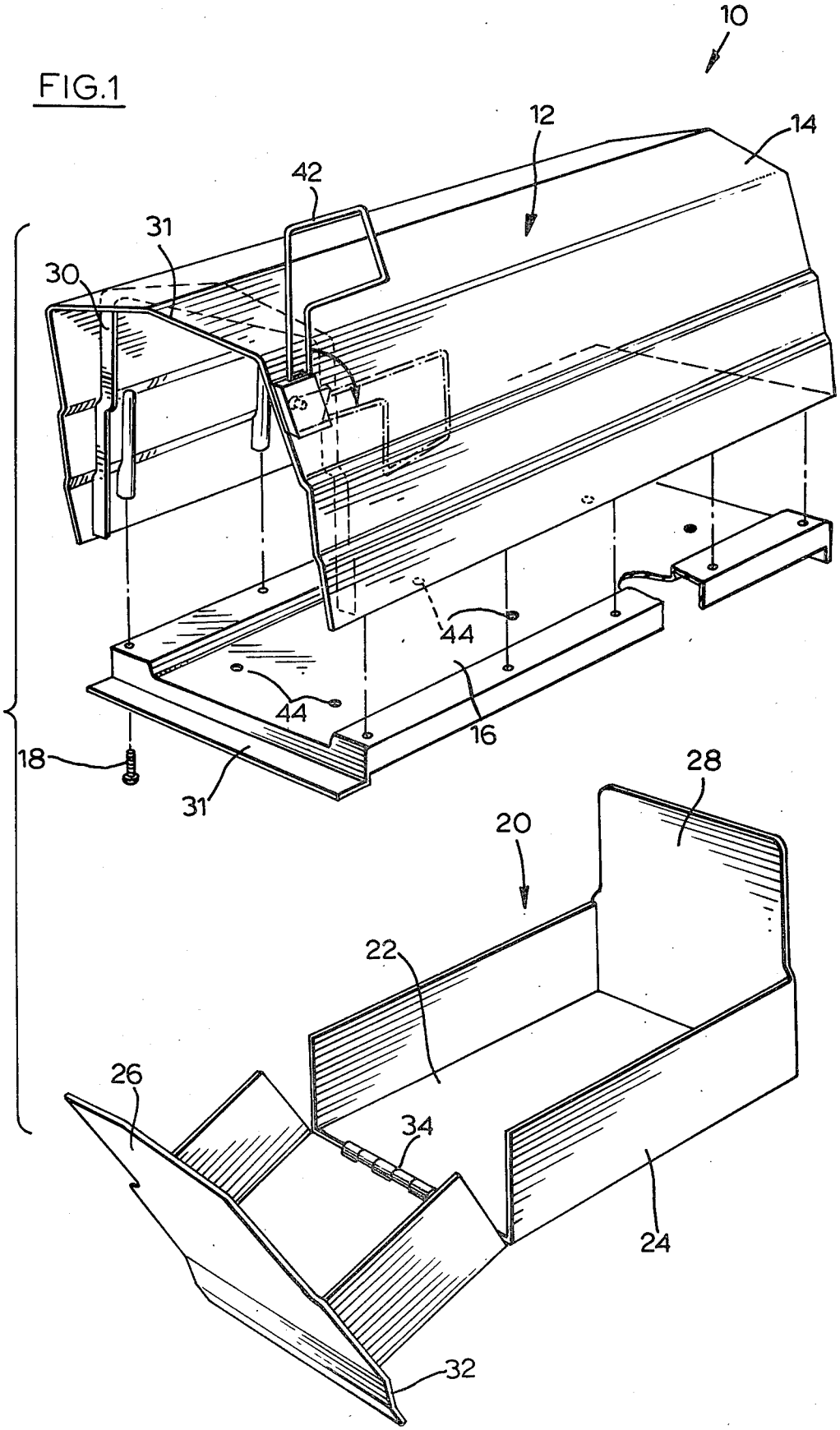
FIG. 1 is a perspective exploded view of the component parts of a rural mail box provided in accordance with a preferred embodiment of the invention.
Figure 2:
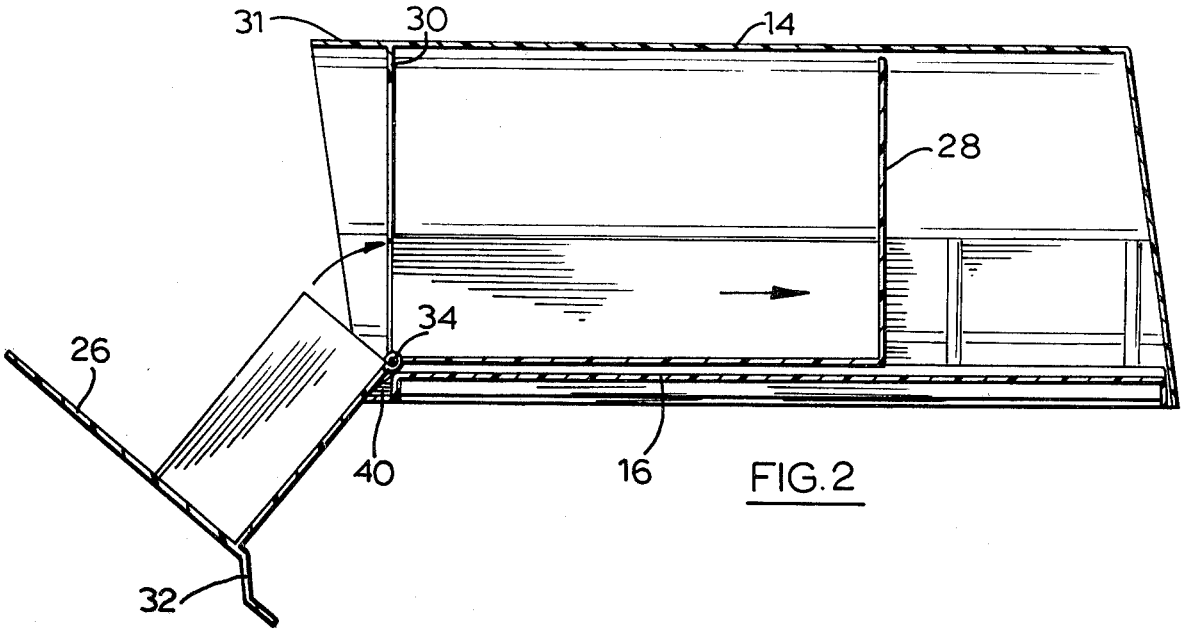
FIG. 2 is an elevational sectional view of the mail box of FIG. 1 in an open mail-receiving position.

Referring to the drawings, a rural mail box 10 comprises an enclosure 12 consisting of an upper cover member 14 which is open at one end and closed at the other and a bottom closure member 16 secured to the cover member 14, such as, by screws 18. The mail box 10 further comprises a tray 20 which is slidably positioned on longitudinal side margin portions of the bottom closure member 16 within the enclosure 12.

Figure 3:
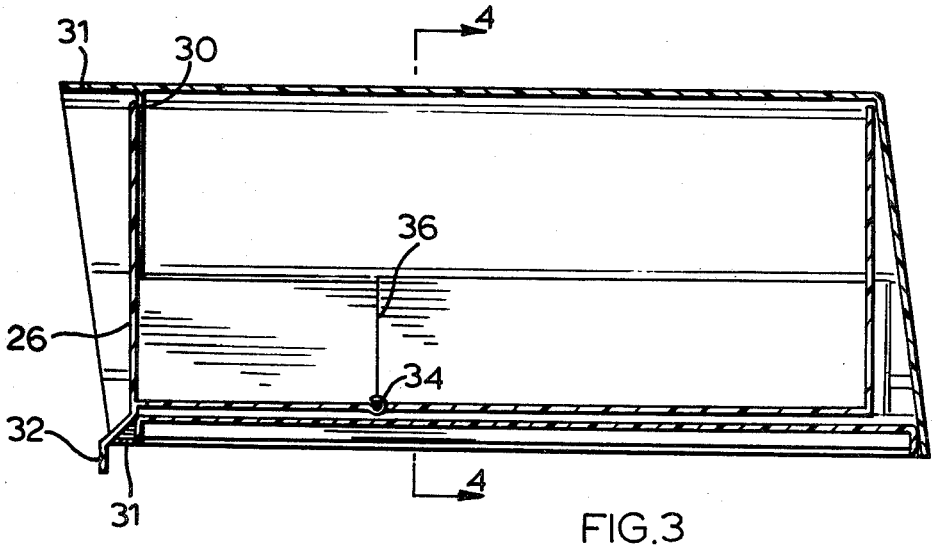
FIG. 3 is an elevational sectional view of the mail box of FIG. 1 in the closed position.

The tray 20 includes a base 22, longitudinal side walls 24 upstanding from the base 22 and end walls 26 and 28 upstanding from the base 22. The front end wall 26 serves as a front closure or door for the mail box 10 while the rear end wall 28 prevents mail from falling from the rear of the tray 20. In the closed position (FIG. 3) the front end wall 26 abuts a stop flange 30 projecting from the inner wall of the cover member 14.

The stop flange 30 is inwardly located with respect to the open end of the enclosure 12 to provide an overhang portion 31 at the front end of the mail box 10 which prevents the ingress of rain or snow into the interior of the mail box at the abutment of the front closure wall 26 and the top flange 30.

The bottom closure member 16 has a forwardly projecting flange 31 whose purpose is described below, extending from the lower extremity of a depending skirt portion thereof. The front end wall 26 includes a depending skirt portion 32 which is shaped to avoid interference with the flange 31 and provides a plate which can be gripped for drawing out the tray 20.

The tray 20 is formed in two hinge connected portions. Thus, a hinge 34 is positioned in the base 22 extending transversely thereof, and the side walls 24 are separated into two portions at the same location by vertical dividing lines 36. The front part of the side walls 24 extend upwardly a slightly lesser distance than the rear part of the side walls 24, as may be seen in FIG. 3.

Figure 4:
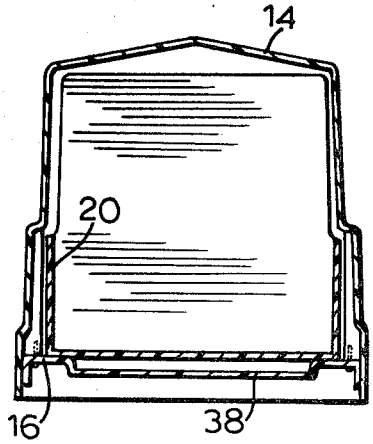
FIG. 4 is a sectional view taken on line 4—4 of FIG. 3.

The bottom closure member 16 has a shallow recessed portion 38 along its length to accommodate the hinge 34, as may be most clearly seen in FIG. 4.

When access is required to the mail box 10, the tray 20 is slid out of the enclosure 12 by pulling on the skirt portion 32 until the hinge 34 clears the forward extremity of the bottom closure member 16 permitting the forward portion of the tray 20 to hinge downwardly thereby providing almost unimpeded access to the interior of the mail box 10. In this position, the leading edges of the walls 24 of the rear portion of the tray 20 abut the flange 30 preventing further forward movement of the tray 20.

The forwardly directed flange 31 acts as a stop limiting the extend of downward movement of the forward portion of the tray 20 about the hinge 34. The flange 31 preferably is dimensioned so that the upper extremity of the front wall 26 lies in the same plane as the base 22 in the rear portion of the tray.

Mail or other items may be readily placed in the forward hinged-down tray portion or in the rear portion, as desired, and the mail box 10 reclosed by pushing the tray 20 back into the enclosure 12. Since the forward portion of the tray 20 is hinged downwardly and mail may be positioned in that portion of the tray, the mail box 10 is particularly useful when mail deliveries are made from a motor vehicle.

A flag device 42 is attached to the outer surface of the cover member 14 to signify the presence or absence of delivered items in the mail box.

A plurality of openings 44 is provided through the bottom closure member 16 for mounting the mail box on a wooden adapter or the like.

The mail box 10 may be formed of any convenient material and is preferably formed of thermoplastic polymeric material, preferably by injection molding. The individual components are readily molded and easily assembled to provide the mail box 10. The formation of the mail box 10 from polymeric material provides a rugged structure which resists denting and similar damage commonly suffered by rural mail boxes and enables the product to be provided in a variety of color-fast shades.

The closing of the mail box 10 by pushing in the tray 20 is a fail-safe closure mechanism which is not subject to deterioration in use. The elimination of the spring mechanism in this invention also results in an enhanced external appearance.

SUMMARY

The present invention, therefore, provides a rural mail box of improved form and construction. Modifications are possible within the scope of the invention.

What I claim is:

1. A rural mail box, comprising an elongate enclosure having an open end, and a tray slidably mounted in said enclosure and including an integral front wall closing said open end of said enclosure when said tray is located wholly within said enclosure and opening said enclosure when said tray is slid outwardly from said enclosure, said tray being constituted by two portions hingedly connected together about a transverse hinge, whereby when said tray is slid from said enclosure a distance such that said hinge is just outside said enclosure the forward one of said tray portions hinges downwardly relative to the rearward one of said tray portions.

2. The mail box of claim 1 wherein said enclosure comprises a cover member and a lower closure member connected to said cover member and said tray is slidably mounted on spaced-apart longitudinally-extending portions of said lower closure member.

3. The mail box of claim 2 including stop means on said cover member limiting inward movement of said front wall with respect to said enclosure and limiting outward movement of said tray with respect to said enclosure.

4. The mail box of claim 1 wherein said tray comprises a base member, side walls upstanding from said base member and end walls upstanding from said base, one of said end walls constituting said front end closure wall, said end walls upstanding from said base a distance substantially equal to the height of said enclosure.

5. The mail box of claim 1 wherein said transverse hinge is located approximately ⅓rd of the longitudinal distance from the front wall.

6. The mail box of claim 2 wherein said tray comprises a base member, side walls upstanding from said base member and end walls upstanding from said base, one of said end walls constituting said front end closure wall, said end walls upstanding from said base a distance substantially equal to the height of said enclosure, and said transverse hinge is received within a depressed area of said lower closure member between said spaced-apart portions.

7. The mail box of claim 1 including stop means limiting downward movement of said forward one of said tray portions when said hinging occurs.

8. The mail box of claim 6 including a first flange projecting inwardly of said cover member limiting inward movement of said front wall with respect to said enclosure by engagement with said front wall and limiting outward movement of said tray with respect to said enclosure to a maximum which corresponds to that portion of the hinge which first permits said hinging movement by engagement of said side walls of said rearward tray portion with said first flange, and a second flange projecting forwardly from lower closure member limiting downard movement of said forward one of said tray portions when said hinging occurs.

9. The mail box of claim 8 wherein said second flange limits said downward movement to the extent that the upper edge of said front wall lies substantially in the plane of the base of said rearward tray portion in said hinged position.

10. The mail box of claim 1 wherein said front wall has an integral depending skirt member extending below said enclosure and constituting finger gripping means for outward movement of said tray.

* * * * *

UNITED STATES PATENT AND TRADEMARK OFFICE

CERTIFICATE OF CORRECTION

PATENT NO. : 4,160,520

DATED : July 10, 1979

INVENTOR(S) : George J. Cluthé

It is certified that error appears in the above—identified patent and that said Letters Patent is hereby corrected as shown below:

The title page should be deleted to insert the attached title page therefor.

Signed and Sealed this

*First* Day of *January 1980*

[SEAL]

*Attest:*

SIDNEY A. DIAMOND

*Attesting Officer*

*Commissioner of Patents and Trademarks*

United States Patent [19]

Cluthé

[11] 4,160,520

[45] Jul. 10, 1979

[54] RURAL MAIL BOX

[75] Inventor: George J. Cluthé, Breslau, Canada

[73] Assignee: The Geo. Cluthe Manufacturing Co. Limited, Waterloo, Canada

[21] Appl. No.: 885,969

[22] Filed: Mar. 13, 1978

[51] Int. Cl.[2] ..... B65D 91/00

[52] U.S. Cl. ..... 232/17; 232/45

[58] Field of Search ..... 232/17, 24, 25, 35, 232/38, 45; 312/330

[56] References Cited

U.S. PATENT DOCUMENTS

| | | | |
|---|---|---|---|
| 838,194 | 12/1906 | Larsh | 232/17 |
| 908,543 | 1/1909 | Brown | 232/17 |
| 1,139,491 | 5/1915 | Coon | 232/33 |
| 1,204,580 | 11/1916 | McDonald, Jr. | 232/35 |
| 1,299,740 | 4/1919 | Larson | 232/35 |
| 1,992,640 | 2/1935 | Steen | 232/17 |
| 2,781,964 | 2/1957 | Ledgerwood | 232/17 |
| 2,868,444 | 1/1959 | Whittier | 232/33 X |

*Primary Examiner*—Roy D. Frazier
*Assistant Examiner*—Peter A. Aschenbrenner
*Attorney, Agent, or Firm*—Sim & McBurney

[57] ABSTRACT

A rural mail box is provided having an elongate enclosure and a mail-receiving tray slidable within the enclosure and including an integral front door for the mail box. The tray is hinged part way along its length to permit the front portion thereof to hinge downwardly when the tray is slid part way out to facilitate the positioning of mail in the tray. The mail box is particularly adapted to be formed of plastic material by injection molding.

10 Claims, 4 Drawing Figures

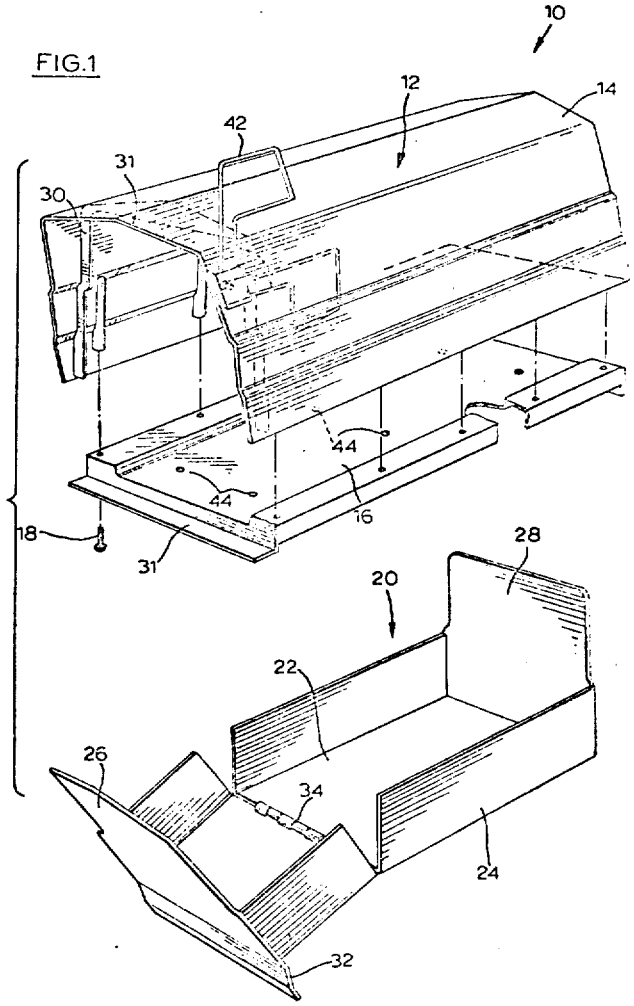

FIG.1